US010926282B2

(12) United States Patent
Ding

(10) Patent No.: US 10,926,282 B2
(45) Date of Patent: Feb. 23, 2021

(54) ANTI-WATER-INGRESS LOTION PUMP

(71) Applicant: Yaowu Ding, Jiangsu (CN)

(72) Inventor: Yaowu Ding, Jiangsu (CN)

(73) Assignee: Yaowu Ding, Jiangsu (CN)

( * ) Notice: Subject to any disclaimer, the term of this patent is extended or adjusted under 35 U.S.C. 154(b) by 0 days.

(21) Appl. No.: 16/463,550

(22) PCT Filed: Nov. 20, 2017

(86) PCT No.: PCT/CN2017/111805
§ 371 (c)(1),
(2) Date: Sep. 12, 2019

(87) PCT Pub. No.: WO2018/095292
PCT Pub. Date: May 31, 2018

(65) Prior Publication Data

US 2020/0016617 A1 Jan. 16, 2020

(30) Foreign Application Priority Data

Nov. 25, 2016 (CN) ..... 201611059983.1

(51) Int. Cl.
*B05B 11/00* (2006.01)

(52) U.S. Cl.
CPC ..... *B05B 11/3046* (2013.01); *B05B 11/3001* (2013.01); *B05B 11/3067* (2013.01)

(58) Field of Classification Search
CPC ..... B05B 11/3046; B05B 11/3001; B05B 11/3067
(Continued)

(56) References Cited

U.S. PATENT DOCUMENTS 3,282,472 A * 11/1966 Roder ..... A47K 5/1205 222/321.9
3,844,452 A * 10/1974 Blum ..... B05B 11/3001 222/321.7
(Continued)

FOREIGN PATENT DOCUMENTS

CN 1064732 A 9/1992
CN 103420021 A 12/2013
(Continued)

OTHER PUBLICATIONS

International Search Report and Written Opinion dated Feb. 26, 2018, for corresponding International Application No. PCT/CN2017/111805; International Filing Date: Nov. 20, 2017 consisting of 8-pages.

*Primary Examiner* — Vishal Pancholi
(74) *Attorney, Agent, or Firm* — Christopher & Weisberg, P.A.

(57) ABSTRACT

Disclosed is a lotion pump comprising: a pressing head (10) comprising a pressing head body (11); a cylinder (30); a cylinder head connected to an upper end of the cylinder and having an inner hole; a threaded sleeve (20) connected to the cylinder head; and a piston rod (40), with one end being connected to the pressing head body, and the other end extending into the cylinder and being provided with a piston (50). The lotion pump further comprises a neck sleeve (13) formed on the pressing head body. A first slope is formed on a lower portion of the neck sleeve, and a second slope matching the first slope is formed on the top of the threaded sleeve. The lotion pump having the foregoing structure can ensure the sealing against the outside when the lotion pump is in a standby state or an upper locked state, so as to prevent water from seeping into the lotion pump during bathing.

5 Claims, 5 Drawing Sheets

(58) Field of Classification Search
USPC ..... 222/321.9
See application file for complete search history.

(56) References Cited

U.S. PATENT DOCUMENTS

| | | | | | |
|---|---|---|---|---|---|
| 4,371,097 | A * | 2/1983 | O'Neill | B05B 11/3011 | 222/321.7 |
| 4,503,996 | A * | 3/1985 | Sorm | B05B 11/3088 | 222/321.9 |
| 5,443,569 | A * | 8/1995 | Uehira | B05B 7/0031 | 222/190 |
| 5,738,250 | A * | 4/1998 | Gillingham | B05B 11/3001 | 222/153.13 |
| 8,827,121 | B2 * | 9/2014 | Law | B05B 11/3001 | 222/321.9 |
| 2011/0297700 | A1 * | 12/2011 | Santagiuliana | B05B 11/3001 | 222/153.13 |

FOREIGN PATENT DOCUMENTS

| | | | |
|---|---|---|---|
| CN | 104058163 | A | 9/2014 |
| CN | 204137529 | U | 2/2015 |
| CN | 106628572 | A | 5/2017 |
| CN | 206203014 | U | 5/2017 |
| KR | 200177948 | Y1 | 4/2000 |

* cited by examiner

ANTI-WATER-INGRESS LOTION PUMP

CROSS-REFERENCE TO RELATED APPLICATIONS

This application is a Submission under 35 U.S.C. § 371 for U.S. National Stage Patent Application of, and claims priority to, International Application Number PCT/CN2017/111805 entitled ANTI-WATER-INGRESS LOTION PUMP, filed Nov. 20, 2017, which is related to and claims priority to Chinese Patent Number 201611059983.1, filed Nov. 25, 2016 the entirety of all of which are incorporated herein by reference.

TECHNICAL FIELD

The present invention relates to a lotion pump, which is applied, for example, to a container of a personal care product such as shampoo and shower gel.

BACKGROUND ART

People often use personal care products such as shampoo and shower gel in daily life. Such a product is usually stored in a container with a dispensing apparatus. Preferably, a lotion pump is used as the dispensing apparatus. When the lotion pump is pressed, the product in the container can be easily delivered for use by a user.

There are some problems regarding lotion pumps. It is sometimes observed that water occasionally seeps into a packaging container through the lotion pump during bathing. As a result, the product in the container is contaminated and degraded. For example, molds grow in the product inside the container due to bathing water that seeps into the container. This has particularly significant impact on infant care products, since babies have delicate skin and are more susceptible to skin problems caused by the degraded infant care products.

The inventor has found that there are mainly two cases in which water seeps into the container through the lotion pump: in the first case, water sprayed from a shower head seeps into the container from above during showering; and in the second case, the container with a lotion pump sometimes accidentally slips into a bathtub during tubbing, as a result, the lotion pump is immersed in water, and at this time, water will seep into the container through an air replenishment channel provided in the lotion pump for preventing negative pressure inside the container.

For example, FIG. 8 shows a sectional view of a lotion pump in the prior art. As shown in FIG. 8, the lotion pump 100 comprises a pressing head 110, a threaded sleeve 120, a cylinder 130, a piston rod 140, and a piston 150 connected to a lower end of the piston rod 140. The pressing head 110 comprises a main body 111 and a pressing nozzle 112. In an installed state, the main body 111 extends into the threaded sleeve 120, and an outer surface of the main body 111 mates with an inner surface of the top of the threaded sleeve 120. As shown in FIG. 8, a gap is provided at a portion where the pressing head 110 mates with the threaded sleeve 120. During use, the gap allows inflow of external air through the lotion pump 100 during bathing, and water is likely to seep into the lotion pump 100 through the gap and in turn enters a container that accommodates a product.

Therefore, existing lotion pumps need to be improved to prevent water from seeping into a container for a product during bathing in any case.

SUMMARY OF THE INVENTION

The present invention is provided to solve the foregoing problems in the prior art. An object of the present invention is to provide an anti-water-ingress lotion pump, which can prevent water from seeping into a container installed with the lotion pump during both showering and tubbing. For example, water sprayed from a shower head can be prevented from seeping into the container from above, and can also be prevented from seeping into the container when the lotion pump accidentally falls into a bathtub.

The foregoing object of the present invention is implemented by using a lotion pump having the following structure. The lotion pump comprises: a pressing head comprising a pressing head body; a cylinder; a cylinder head connected to an upper end of the cylinder and having an inner hole; a threaded sleeve connected to the cylinder head; and a piston rod, with one end being connected to the pressing head body, and the other end extending into the cylinder and being provided with a piston;

wherein the lotion pump further comprises a neck sleeve formed on the pressing head body and capable of extending into the inner hole, wherein the neck sleeve comprises a first part located at a lower portion and a second part located at an upper portion, and a first slope is formed on an outer surface of the first part;

a second slope is formed in the inner hole of the cylinder head a maximum outer diameter of the first part of the neck sleeve is greater than a minimum inner diameter of the cylinder head at the second slope, so that when the lotion pump is in a standby state or an upper locked state, there is an interference fit between the first slope and the second slope to form a seal between the cylinder head and the neck sleeve; and, the outer diameter of the second part of the neck sleeve is less than the minimum diameter of the cylinder head at the second slope, so that when the lotion pump is in the process of being pressed down, as the first slope is disengaged from contact with the second slope, a gap is formed between the neck sleeve and the cylinder head.

By means of the lotion pump having the foregoing structure, especially, the mating between the first slope and the second slope can ensure that when the lotion pump is in its standby state or upper locked state, water is prevented from seeping into the lotion pump and from flowing into a container. Particularly, for the first slope and the second slope, their slope configuration is such that a surface seal is formed between the neck sleeve and the cylinder head, and therefore the seal is more reliable. During use, as the pressing head of the lotion pump is in the process of being pressed down, the slope configuration facilitates disengagement of the first slope from the second slope to form a channel that allows ingress of external air, so as to prevent the formation of negative pressure in the container during use.

In a structure, the neck sleeve is formed integrally on the pressing head body. Of course, the neck sleeve and the pressing head body may be separately formed and are then connected together by using any known method in the art.

In addition, the cylinder head and the threaded sleeve may also be integrally or separately formed.

Preferably, the lotion pump may further comprise a fixed sheath, which is fixedly provided in the cylinder, and comprises an inner hole for the piston rod to pass through, wherein a third slope is formed at an upper end of the piston, a fourth slope matching the third slope in shape is formed at a lower end of the fixed sheath, when the lotion pump is in the standby state or the upper locked state, there is an interference fit between the third slope and the fourth slope to form a seal between the fixed sheath and the piston, and as the pressing head of the lotion pump is pressed down, the third slope and the fourth slope are disengaged from each other.

The arrangement of the third slope and the fourth slope can further improve the sealing performance when the lotion pump is in the standby state or the upper locked state.

The third slope is formed on an inner surface of the upper end of the piston, and the fourth slope is formed on an outer surface of the lower end of the fixed sheath; or, the third slope may be formed on an outer surface of the upper end of the piston, and the fourth slope may be formed on an inner surface of the lower end of the fixed sheath.

DETAILED DESCRIPTION OF EMBODIMENTS

Particular embodiments of the present invention are described below in detail with reference to FIGS. 1 to 7*b*. It should be understood that only preferred embodiments of the present invention are shown in the accompanying drawings and are not intended to constitute a limitation to the scope of the present invention. A person skilled in the art can make various obvious modifications, variations, and equivalent replacements to the present invention based on the embodiments shown in the accompanying drawings, and these modifications, variations, and equivalent replacements all fall within the scope of protection of the present invention.

It should be noted herein that the orientation terms such as "up" and "down" mentioned herein are described with reference to the orientation of a lotion pump in a normal use state.

First Embodiment

Figure 1:
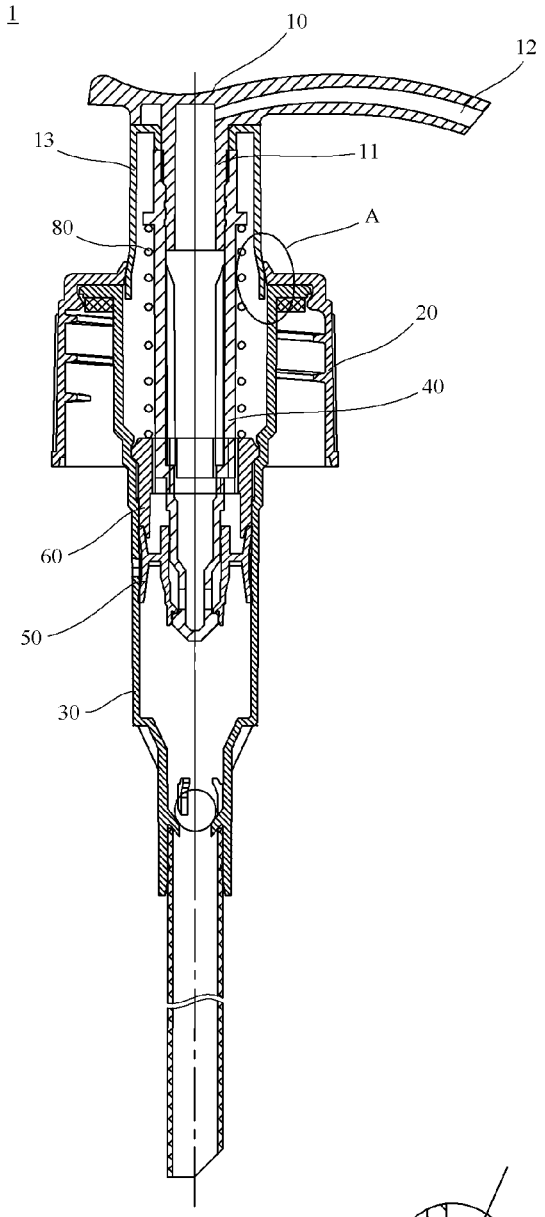
FIG. 1 is a sectional view of a lotion pump of a first embodiment of the present invention, with the lotion pump being in a standby state or an upper locked state.
Figure 1A:
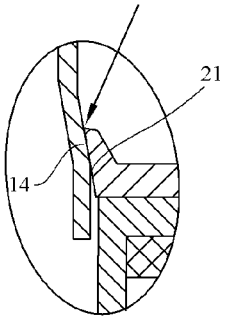
FIG. 1*a* is an enlarged view of a part A in FIG. 1.
Figure 2:
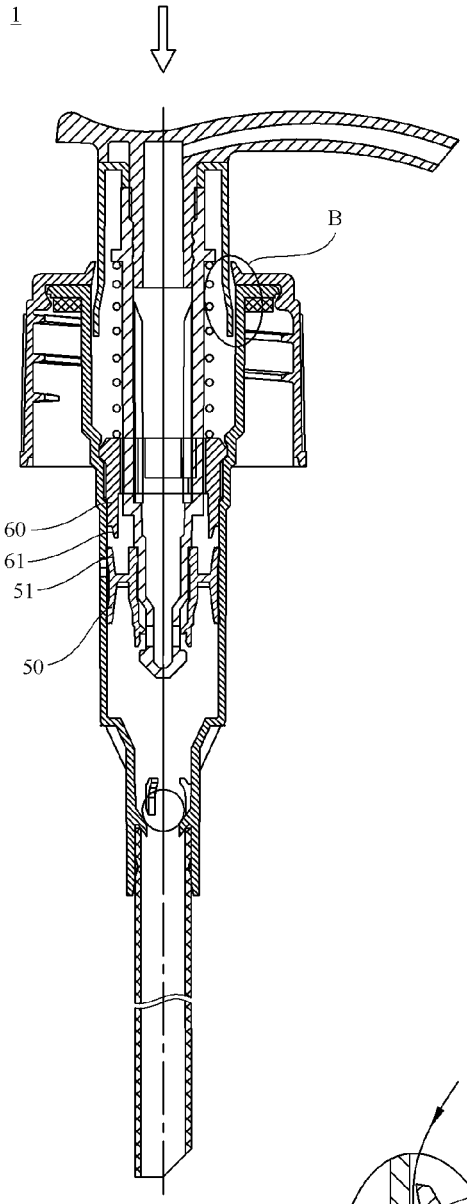
FIG. 2 is another sectional view of the lotion pump shown in FIG. 1, with the lotion pump being in the process of being pressed down.
Figure 2A:
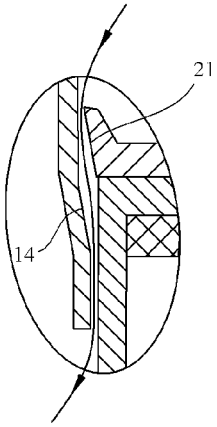
FIG. 2*a* is an enlarged view of a part B in FIG. 2.
Figure 3A:
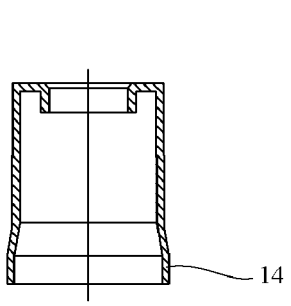
FIG. 3*a* is a sectional view of a neck sleeve of the lotion pump shown in FIGS. 1 and 2.
Figure 3B:
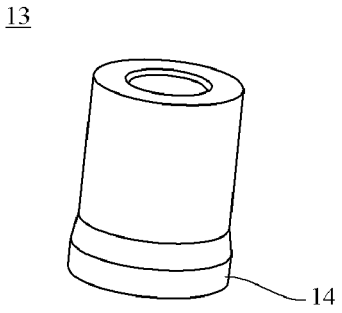
FIG. 3*b* is a perspective view of the neck sleeve shown in FIG. 3*a*.
Figure 4A:
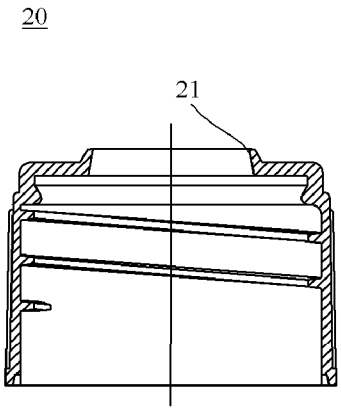
FIG. 4*a* is a sectional view of a threaded sleeve of the lotion pump shown in FIGS. 1 and 2, with a cylinder head of the lotion pump being formed integrally on the threaded sleeve.
Figure 4B:
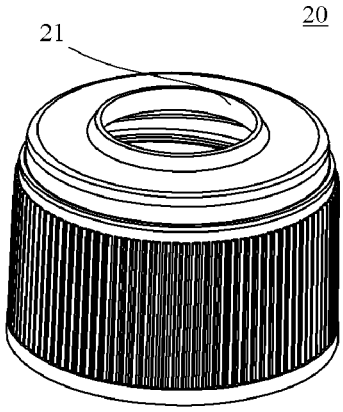
FIG. 4*b* is a perspective view of the threaded sleeve shown in FIG. 4*a*.

FIGS. 1 to 2*a* show a lotion pump 1 of the first embodiment of the present invention. FIG. 1 shows a sectional view of the lotion pump 1 in a standby state. FIG. 1*a* is an enlarged view of a part A in FIG. 1. FIG. 2 shows a sectional view of the lotion pump 1 in the process of being pressed down. FIG. 2*a* shows an enlarged view of a part B in FIG. 2.

As shown in FIGS. 1 and 2, the lotion pump 1 comprises a pressing head 10, a threaded sleeve 20, and a cylinder 30. The threaded sleeve 20 is connected to the cylinder 30 and covers an upper end of the cylinder 30. The pressing head 10 comprises a pressing head body 11 and an optional pressing nozzle 12 provided on the pressing head body 11. A piston rod 40 is connected to a lower end of the pressing head body 11. The piston rod 40 extends into the cylinder 30, and a piston 50 is provided at the end of the piston rod 40 that extends into the cylinder 30.

A spring 80 is further provided inside the cylinder 30. The spring 80 applies an upward biasing force to the piston rod 40, so that when the lotion pump 1 is in the standby state, the spring 80 biases the pressing head 10 upward by using the biasing force applied to the piston rod 40. In addition, when the pressing head 10 is in an upwardly biased position, the pressing head 10 may be rotated, so that the pressing head 10 is locked via a construction such as a thread, so as to define the lotion pump 1 in an upper locked state thereof.

In the first embodiment shown in FIGS. 1 and 2, the spring 80 is provided externally, that is, the spring 80 is located outside a space filled with a product in the cylinder 30. Certainly, the spring 80 may also be of an in-built structure, that is, the spring 80 is located inside the space filled with the product in the cylinder 30. This will be described below in detail.

A neck sleeve 13 is further provided in the lotion pump 1 of the present invention. The neck sleeve 13 is formed on the pressing head 10, for example, is formed separately and then connected to the pressing head 10 in any manner known in the prior art, or is formed integrally with the pressing head 10 in a process of forming the pressing head 10. A first flaring slope 14 is formed on an outer peripheral surface of a lower end of the neck sleeve 13. The structure in which the first slope 14 is provided can be seen more clearly in FIGS. 3*a* and 3*b* in which the neck sleeve 13 is shown separately.

Correspondingly, a second slope 21 is formed in an inner hole for accommodating the neck sleeve 13 in the threaded sleeve 20. The structure in which the second slope 21 is provided is shown more clearly in FIGS. 4*a* and 4*b* in which the threaded sleeve 20 is shown separately.

When the lotion pump 1 is in the standby state or the upper locked state shown in FIG. 1, the first slope 14 is in contact with the second slope 21, and an interference fit is formed between the first slope 14 and the second slope 21, so that a seal is formed between the neck sleeve 13 and the threaded sleeve 20. The interference fit may be implemented by setting, for example, a maximum outer diameter of the neck sleeve 13 at the first slope 14 to be greater than a minimum inner diameter of an inner hole of the threaded sleeve 20 at the second slope 21. The sealing fit structure is shown more clearly in the enlarged view in FIG. 1*a*.

In this way, when the lotion pump 1 is in the standby state or the upper locked state shown in FIG. 1, water cannot seep into the lotion pump 1 in any case, and therefore cannot seep into a container installed with the lotion pump 1. Specifically, during showering, when the lotion pump 1 is in the standby state or the upper locked state, the sealing fit between the first slope 14 of the neck sleeve 13 and the second slope 21 of the threaded sleeve 20 prevents water from flowing into the lotion pump 1; and during tubbing, even if the container installed with the lotion pump 1 is accidentally or deliberately immersed in water, the sealing fit between the first slope 14 of the neck sleeve 13 and the second slope 21 of the threaded sleeve 20 can still effectively prevent the ingress of water.

Further, the outer diameter of the part other than the first slope 14 of the neck sleeve 13 is set to be less than the minimum inner diameter of the threaded sleeve 20 at the second slope 21. In this way, when the product in the container needs to be used, a user presses down the pressing head 10 to enable the neck sleeve 13 to move downward as shown in FIG. 2, so that the product in the cylinder 30 of the lotion pump 1 can be pumped out.

In this process, the first slope 14 of the neck sleeve 13 is disengaged from the second slope 21 of the threaded sleeve 20 to form a gap between the outer surface of the neck sleeve 13 and the inner surface of the threaded sleeve 20. As shown more clearly in FIG. 2*a*, in this way, external air may flow into the lotion pump 1 through the gap and flow into the container through the lotion pump 1. In this way, it is possible to prevent the formation of negative pressure in the container as the accommodated product is pumped out.

In an optional structure, in the lotion pump 1 shown in FIG. 1, a fixed sheath 60 is further fixedly provided in the cylinder 30. The fixed sheath 60 has an inner hole for the piston rod 40 to pass through. As shown in FIGS. 1 and 2, the fixed sheath 60 divides the space in the cylinder into two parts, wherein the space below the fixed sheath 60 may accommodate the product from the container, and the product cannot enter the space above the fixed sheath 60 due to the presence of the fixed sheath 60. Preferably, in the structure shown in FIG. 1, a third slope 51 is formed on an inner surface of an upper end of the piston 50, and a fourth slope 61 matching the third slope 51 is formed on an outer surface of a lower end of the fixed sheath 60.

In another equivalent structure that is not shown, the third slope 51 may be formed on an outer surface of the upper end of the piston 50, and the fourth slope 61 is formed on an inner surface of the lower end of the fixed sheath 60.

As shown in FIG. 1, when the lotion pump 1 is in the standby state or the upper locked state, the third slope 51 and the fourth slope 61 mate with each other to form an additional seal. When the lotion pump 1 is in the process of being pressed down, as shown in FIG. 2, the piston 50 moves downward together with the piston rod 40, so that the third slope 51 of the piston 50 is disengaged from the fourth slope 61 of the fixed sheath 60 to form a channel that allows the passage of external air.

The arrangement of the third slope 51 and the fourth slope 61 can further ensure the sealing of the lotion pump 1 with respect to the outside in the standby state or the upper locked state, so as to prevent water from flowing into the container during bathing.

Second Embodiment

Figure 5:
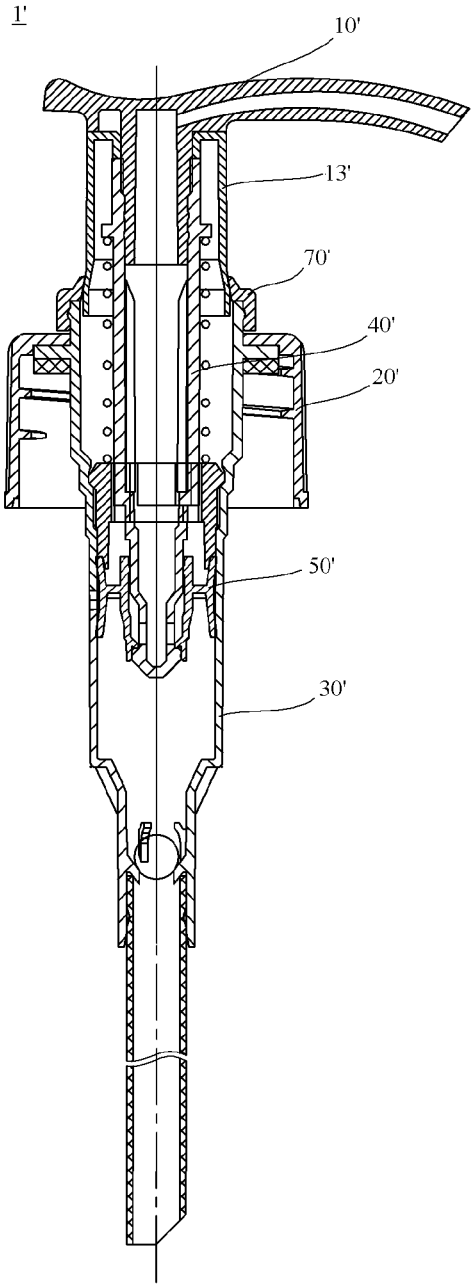
FIG. 5 is a sectional view of a lotion pump of a second embodiment of the present invention, with the lotion pump being in a standby state or an upper locked state, and a cylinder head and a threaded sleeve being separately formed in the lotion pump.
Figure 6:
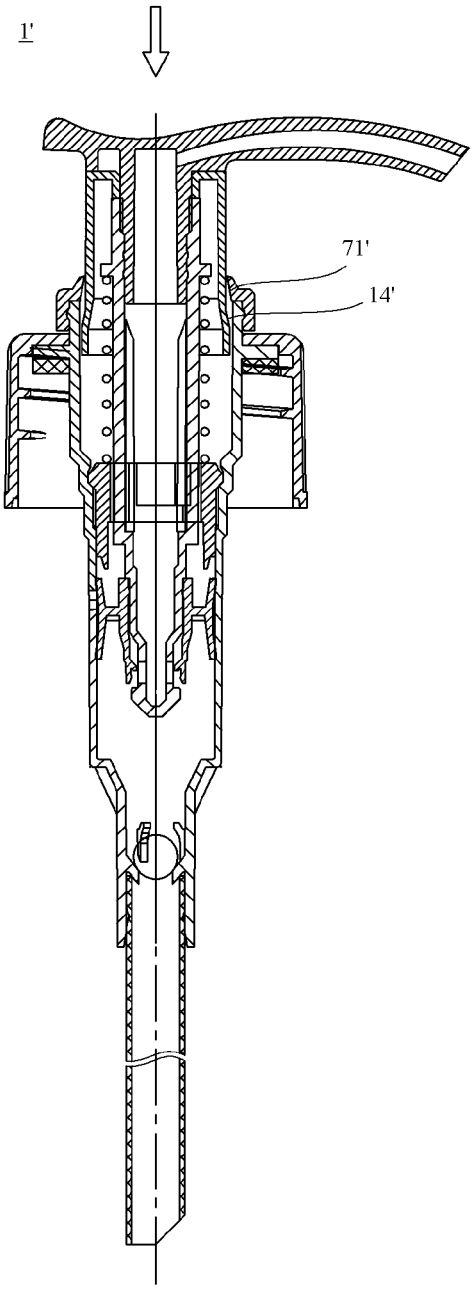
FIG. 6 is another sectional view of the lotion pump shown in FIG. 5, with the lotion pump being in the process of being pressed down.

FIGS. 5 and 6 show a lotion pump 1' according to the second embodiment of the present invention. FIG. 5 shows a sectional view of the lotion pump 1' in a standby state or an upper locked state. FIG. 6 shows a sectional view of the lotion pump 1' in the process of being pressed down. Differences between the lotion pump 1' in the second embodiment and the lotion pump 1 in the first embodiment are mainly described below.

The lotion pump 1' of the second embodiment also comprises a pressing head 10', a threaded sleeve 20', a cylinder 30', a piston rod 40', and a piston 50' installed at a lower end of the piston rod 40'. Different from the first embodiment, the lotion pump 1' of the second embodiment comprises a cylinder head 70' formed separately from the threaded sleeve 20', and the threaded sleeve 20' and the cylinder head 70' are connected together when the lotion pump 1' is in an installed state. In other words, the threaded sleeve 20 in the first embodiment may be considered as a case where the threaded sleeve and the cylinder head are integrally formed.

In the second embodiment, a second slope 71' is formed on an inner surface of the top of the cylinder head 70', and mates with a first slope 14' on a neck sleeve 13' to form a sealing structure, thereby preventing water from seeping into the lotion pump 1' during bathing.

Other structures of the lotion pump 1' of the second embodiment are basically the same as those of the lotion pump 1 of the first embodiment, and will not be repeatedly described herein.

Third Embodiment

Figure 7:
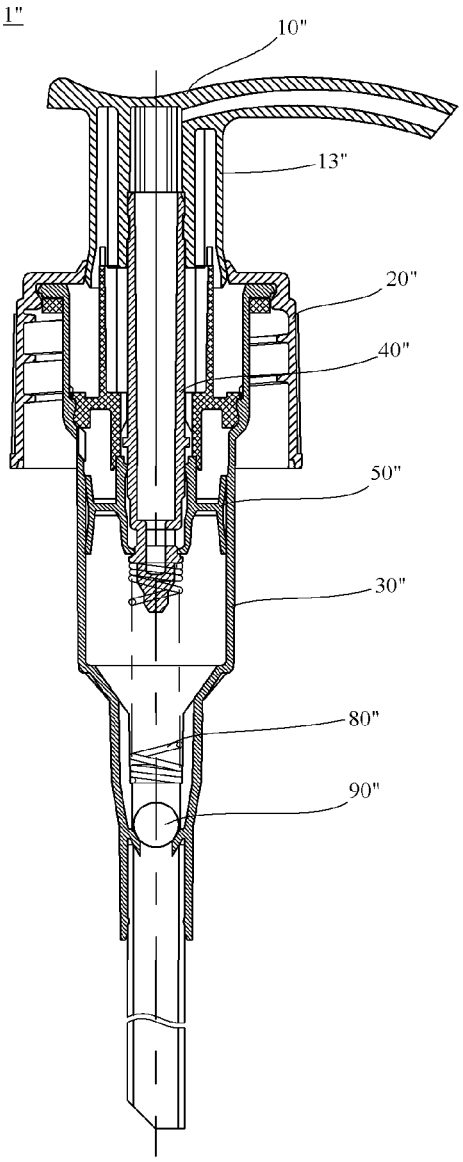
FIG. 7 is a sectional view of a lotion pump of a third embodiment of the present invention, with a neck sleeve being formed integrally on a pressing head body of a pressing head.
Figure 7A:
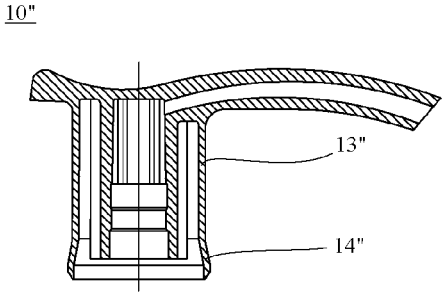
FIG. 7*a* is a sectional view of the pressing head of the lotion pump shown in FIG. 7.
Figure 7B:
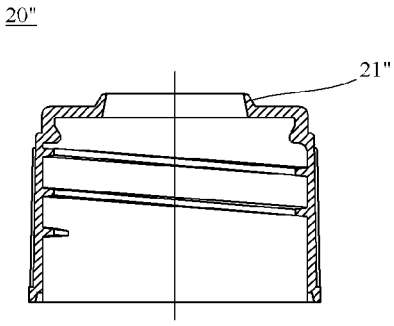
FIG. 7*b* is a sectional view of a threaded sleeve of the lotion pump shown in FIG. 7.
Figure 8:
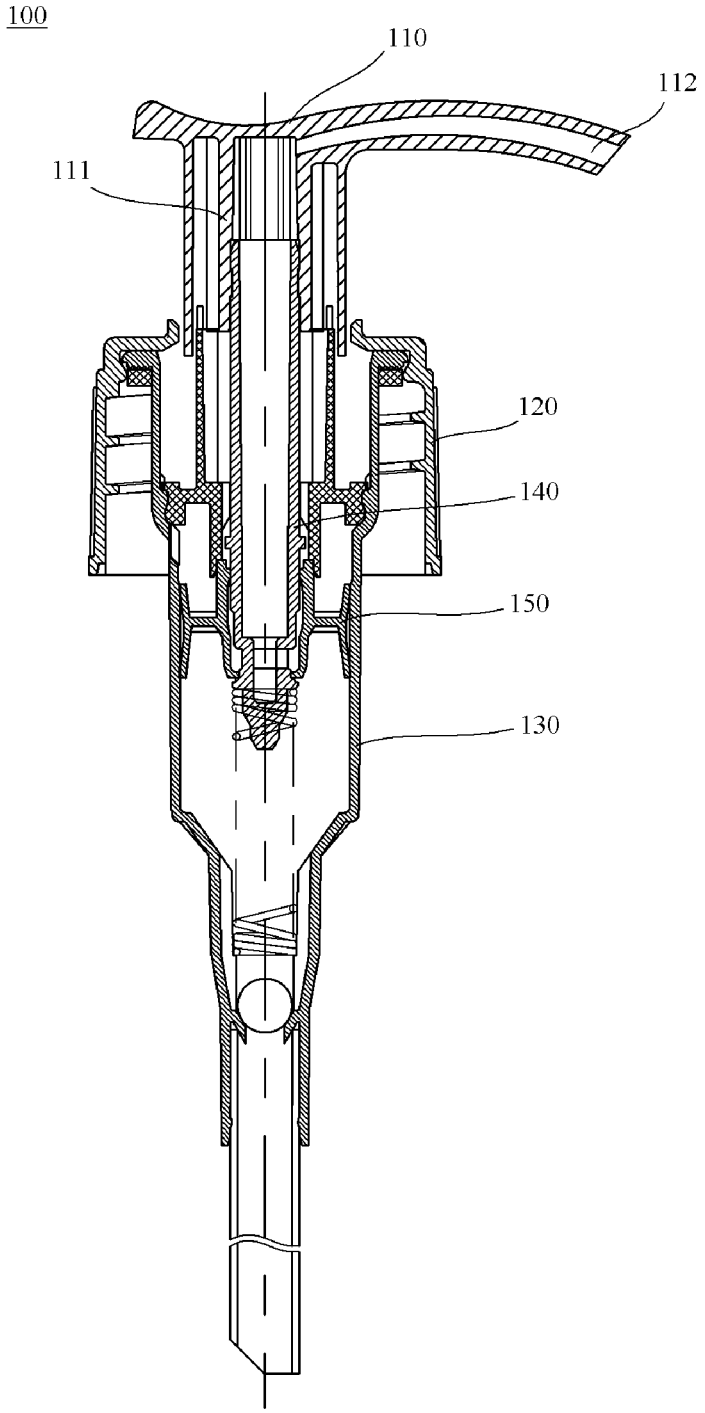
FIG. 8 shows a sectional view of a lotion pump in the prior art.

FIGS. 7 to 7*b* show a lotion pump 1" of a third embodiment of the present invention. FIG. 7 shows a sectional view of the lotion pump 1". FIG. 7*a* shows a sectional view of a pressing head 10". FIG. 7*b* shows a sectional view of a threaded sleeve 20". Differences between the lotion pump 1" in the third embodiment and the lotion pump 1 in the first embodiment are mainly described below.

As shown in FIG. 7, in the lotion pump 1" of the third embodiment, a neck sleeve 13" is formed integrally on the pressing head 10", as shown more clearly in FIG. 7*a*. In other words, the neck sleeve 13" forms a part of a pressing head body of the pressing head 10". A first slope 14" is formed on an outer surface of a lower end of the neck sleeve 13".

FIG. 7*b* shows a sectional view of the threaded sleeve 20" of the lotion pump 1" of the third embodiment. It can be seen that the structure of the threaded sleeve 20" is basically the same as that of the threaded sleeve 20 in the first embodiment, and therefore will not be repeatedly described herein.

Another difference between the lotion pump 1" of the third embodiment and the lotion pump 1 of the first embodiment is that in the third embodiment, a spring 80" is of an in-built type, i.e., provided in a space where the product is accommodated in a cylinder 30". In other words, as shown in FIG. 7, one end of the spring 80" is connected to a lower end of a piston rod 40" and the other end thereof is supported on a valve 90" at the bottom of the cylinder 30", and the spring applies an upward biasing force to the piston rod 40".

Other structures of the lotion pump 1" of the third embodiment are basically the same as those of the lotion pump 1 of the first embodiment, and therefore will not be repeatedly described herein.

The invention claimed is:

1. A lotion pump comprising:

a pressing head with a pressing head body;

a cylinder;

a cylinder head connected to an upper end of the cylinder and having an inner hole;

a threaded sleeve connected to the cylinder head; and a piston rod, with one end being connected to the pressing head body, and the other end extending into the cylinder and being provided with a piston, the lotion pump further including a neck sleeve formed on the pressing head body and capable of extending into the inner hole, where the neck sleeve includes a first part located at a lower portion and a second part located at an upper portion, and a first slope is formed on an outer surface of the first part;

a second slope is formed in the inner hole of the cylinder head, and a maximum outer diameter of the first part of the neck sleeve is greater than a minimum inner diameter of the cylinder head at the second slope, so that when the lotion pump is in a standby state or an upper locked state, there is an interference fit between the first slope and the second slope to form a seal between the cylinder head and the neck sleeve; and the outer diameter of the second part of the neck sleeve is less than the minimum diameter of the cylinder head at the second slope, so that when the lotion pump is in the process of being pressed down, as the first slope is disengaged from contact with the second slope, a gap is formed between the neck sleeve and the cylinder head.

2. The lotion pump of claim 1, wherein the neck sleeve is formed integrally on the pressing head body.

3. The lotion pump of claim 1, wherein the cylinder head and the threaded sleeve are integrally formed.

4. The lotion pump of claim 1, further comprising a fixed sheath, which is fixedly provided in the cylinder, and includes an inner hole for the piston rod to pass through, where a third slope is formed at an upper end of the piston, a fourth slope matching the third slope in shape is formed at a lower end of the fixed sheath, when the lotion pump is in the standby state or the upper locked state, there is an interference fit between the third slope and the fourth slope to form a seal between the fixed sheath and the piston, and as the pressing head of the lotion pump is pressed down, the third slope and the fourth slope are disengaged from each other.

5. The lotion pump of claim 4, wherein the third slope is formed on an inner surface of the upper end of the piston, and the fourth slope is formed on an outer surface of the lower end of the fixed sheath, or the third slope is formed on an outer surface of the upper end of the piston, and the fourth slope is formed on an inner surface of the lower end of the fixed sheath.

* * * * *